United States Patent [19]

Nickle

[11] 4,199,014

[45] Apr. 22, 1980

[54] AUTOMATIC FEEDING SCREWDRIVER

[76] Inventor: Kenneth E. Nickle, 5131 Mountain Man Dr., Kearns, Utah 84118

[21] Appl. No.: 882,651

[22] Filed: Mar. 2, 1978

[51] Int. Cl.[2] ..... B26D 85/24; B25B 23/04

[52] U.S. Cl. ..... 144/32 R; 29/240; 29/526 R; 29/798; 206/338; 221/69; 227/95; 227/120; 227/136

[58] Field of Search ..... 29/240, 798, 413, 432, 29/526 R, 526 A; 221/70–74, 69; 81/52.4 R; 206/338; 227/95, 120, 136; 144/32

[56] References Cited

U.S. PATENT DOCUMENTS

| | | | |
|---|---|---|---|
| 2,706,039 | 4/1955 | Springate | 206/338 |
| 3,601,168 | 8/1971 | Fernstrom | 144/32 |
| 3,783,491 | 1/1974 | Meitz | 29/240 |
| 3,930,297 | 1/1976 | Potucek et al. | 144/32 R |
| 4,047,611 | 9/1977 | Damratowski | 144/32 R |
| 4,062,388 | 12/1977 | DeCaro | 144/32 R |
| 4,062,389 | 12/1977 | Lejdegard | 144/32 R |

*Primary Examiner*—Robert L. Spruill
*Assistant Examiner*—W. D. Bray
*Attorney, Agent, or Firm*—Thorpe, North & Gold

[57] ABSTRACT

A power screwdriver for use with a flexible string of disconnected screws retained in head to tip orientation by attachment to a continuous length of plastic, paper or similar flexible material. The string of screws feeds into a rearward section of a reciprocating shaft of the power screwdriver where the screws are individually advanced into alignment with an engaging bit, the combination bit and shaft being continuously rotated during the course of use. As the forward screw is prepared for engagement by the rotating bit, the retaining plastic or similar material is severed, leaving the forward screw free for emplacement. The screw is engaged and advanced to a forward opening of the shaft by thrust pressure applied by the user to reciprocate the shaft rearward with respect to a power train which is keyed to continuously rotate the shaft and bit. When the thrust pressure is withdrawn, a spring compressed by the rearward motion of the shaft returns the shaft forward to a stable position. In conjunction with this motion, a dog mounted within the shaft catches the head of a lead screw and carries it forward for engagement by the bit. As the thrust pressure is sequentially applied and released, the constantly rotating bit engages and drives the severed screw into a wall or other receiving material. This process may be repeated without interruption until the string of screws is exhausted.

28 Claims, 10 Drawing Figures

AUTOMATIC FEEDING SCREWDRIVER

BACKGROUND OF THE INVENTION

1. Field of Invention

This invention relates to automatic screwdriver apparatus, and more particularly to such apparatus having means for continually feeding screws into position for emplacement by a power screwdriver.

2. Prior Art

It is acknowledged that power screwdrivers capable of automatic, sequential emplacement of screws have existed for some time. The first line of such apparatus consisted of automatic screwdrivers used in connection with screw strips or sticks which consisted of a rigid line of screws integrally attached end to end. Examples of such apparatus are disclosed in U.S. Pat. Nos. 3,356,112; 3,421,557; 3,157,212 and 3,299,499. Because of the rigid structure of the screw strip, loss of linear alignment was not a problem and jamming occurred primarily because of failure of the respective screws to properly seat prior to emplacement. The lead screw of the screw strip was typically severed by wrenching it from its attached position to the following screw strip members.

Because of the limited applications of screw strips, subsequent power screwdrivers were developed for the purpose of channeling free screws into an alignment position for engagement by a bit means such as disclosed in U.S. Pat. No. 3,783,491. This reference suggests the use of a magazine for feeding unconnected screws into a drive shaft for subsequent engagement by a bit. A subsequent magazine-type fastener tool utilizing nails is disclosed in U.S. Pat. No. 3,543,987. Utilization of such a magazine arrangement, however, involves substantial expense and adds bulk to the overall structure of the power screwdriver.

What is needed, therefore, is an automatic loading, power screwdriver which does not require a magazine for arrangement and feeding of screws into an alignment chamber for engagement by a bit or similar driving means. It would be further beneficial to have such a power screwdriver which requires minimal manual manipulation during use and incurs little or no jamming difficulty.

OBJECTS AND SUMMARY OF THE INVENTION

It is therefore an object of the present invention to provide a power screwdriver which chambers, engages and emplaces individual screws severed from a string of flexibly mounted screws.

It is a further object of the present invention to provide methods for preparing a flexible string of screws suitable for use in a power screwdriver unit.

An additional object of the present invention is to provide a power screwdriver which requires no other manipulation other than a forward thrust by the user to emplace an automatically loaded and engaged screw.

A still further object of this invention is to provide a power screwdriver capable of severing individual screws from a string of flexible screws for alignment and engagement by a bit.

Yet another object of this invention is to provide an improved method for advancing a series of attached screws through a power screwdriver for mounting thereby.

A further object of this invention is to provide an automatic screwdriver housing adapted for attachment to various types of power sources.

These and other objects of the present invention are realized in a power screwdriver apparatus for automatically feeding and emplacing a plurality of screws in a wall or similar receiving medium. The apparatus is adapted for use with a flexible string of screws which are attached in head to tip relationship at a length of flexible plastic or similar retaining means. The flexible nature of the string of screws permits easy storage and feeding without concern for special sorting techniques or the utilization of a cartridge-type magazine in connection with feeding such screws into a power screwdriver. The retaining means consists of material which can be severed or broken during the course of advancing the forwardmost screw through the power screwdriver apparatus for emplacement at the wall.

A suitable power screwdriver for use with the subject flexible string of screws consists of a driver housing which is attached to and powered by a coupled power source such as an electric motor. The driver housing includes a channel for receiving the string of screws serially and advancing each successive screw to a forward position within the channel for engagement by a bit tip which is constantly rotated by the power source. By thrusting his weight against the apparatus, a user drives the engaged screw forward to emplace it in the wall or similar medium.

The forward advancement of the string of screws is accomplished by a feed means located rearward within the housing. The feed means successively urges the respective screws forward into a temporary locking position, in which the retaining means between the lead screw and following string of screws is severed or broken. The locked screw is then ejected forward for engagement by dog means within the shaft which retains the screw forward in alignment means operable to maintain the rotating screw and seated bit means in common alignment during emplacement of the screw in the wall. The bit means is seated in the screw as the shaft is pushed rearward into the driver housing, with the screw precessing forward into the wall. As the shaft is released forward, the sequence is repeated with the next lead screw being severed from the advancing string of screws and positioned for engagement by the bit means.

Other objects and features of the present invention will be obvious to a person skilled in the art from the following description, taken in combination with the accompanying drawings.

DETAILED DESCRIPTION OF THE PREFERRED EMBODIMENT

Figure 1:
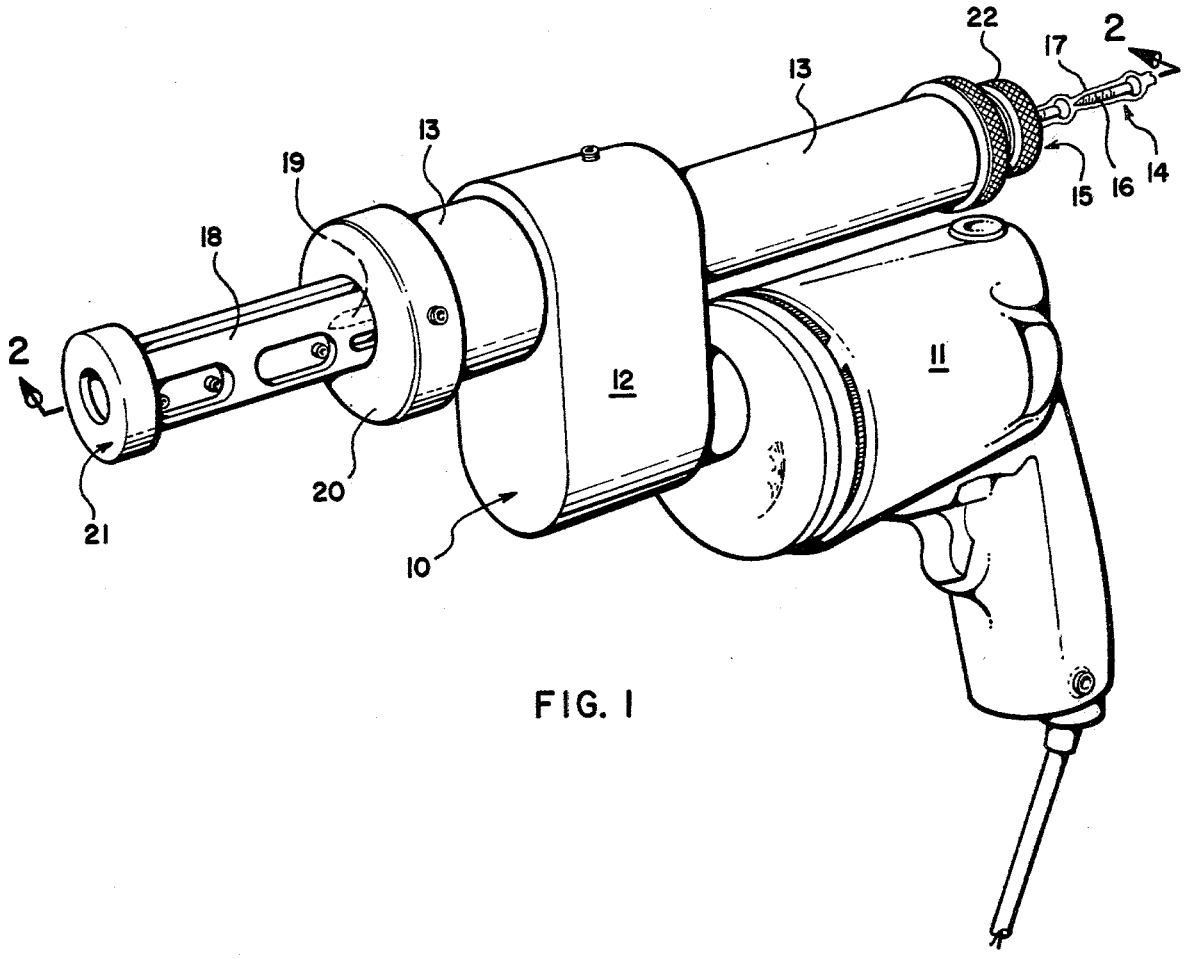
FIG. 1 is a perspective view of the automatic feeding, power screwdriver coupled to a power source.

Referring now to the drawings:

A preferred embodiment of the automatic feeding screwdriver is shown generally 10 in coupled configuration with a power source 11. The power source may be of any type which can develop rotary motion (such as electric or pneumatic means) and is coupled to a power train which is housed in a screwdriver mount 12. This mount 12 carries a driver housing 13 which defines a channel for movement of a flexible string of screws through a rearward opening 15, through the channel and a feed means contained therein for urging such screws forward, to be engaged and mounted by a bit means 19 located within the driver housing channel.

The flexible string of screws 14 consists of individual screw members 16 which are attached to a length of retaining means 17 in head to tip orientation. The retaining means 17 may be of material composition such as plastics, paper, adhesive or any material which permits attachment of each screw member thereto to form a flexible string of head to tip screw members. Because of the flexibility of the retaining means 17, the string of screws can be bent or twisted at each junction of head and tip so that storage in small compartments or boxes is facilitated and problems of sorting or individual screw mounting in a cartridge system are eliminated.

Although single segments of the retaining means may be individually attached to couple a screw head to a following screw tip, the figure illustrates a preferred embodiment which comprises enclosing a line of screws within a thin plastic casing which is easily torn or severed when the material is stretched. Numerous methods are envisioned for encapsulating such a screw arrangement, including shrink wrapping, spraying such a line of screws with a continuous film of plastic or simply contacting the screws in a desired head to tip relation to a line of liquid adhesive medium which dries to a flexible nonadhesive form. The present invention contemplates the use of any such materials which permit fixation of a plurality of screws in head to tip orientation with such material (herein referred to as the retaining means) providing a flexible coupling between the adjacent head and tip to provide an overall flexible character to the formed string of screws.

The lead screw of such a string of screws is fed into the driver housing 13 at the rearward opening 15. This lead screw first contacts a feed means discussed in greater detail hereinafter, which assists in moving the screw forward along the channel within said housing.

A forward section of the driver housing contains a reciprocating shaft 18 which houses the bit means 19 for engaging and mounting the lead screw. A retention cap 20 closes off the forward end of the driver housing 13 and blocks forward movement of the reciprocating shaft 18 beyond a forward limiting point. An impact cap 21 is positioned at the forward end of the reciprocating shaft 18 and is freely rotatable thereon. Such free rotation is necessary in view of the constant rotation of the reciprocating shaft 18 during operation when the face of the impact cap 21 is positioned in stationary contact with the wall or medium to receive the screws. The degree of extension of the bit means 19 forward of the face of the impact cap when the reciprocating shaft is fully depressed into the driver housing is adjustable by means of a knurled adjustment nut 22 located at the rearward opening 15 of the driver housing. This adjustment means cooperates with the driver housing as part of a screw feed mechanism to enable linear adjustment of the bit tip with respect to the driver housing.

Figures 2, 3, 4, 5:
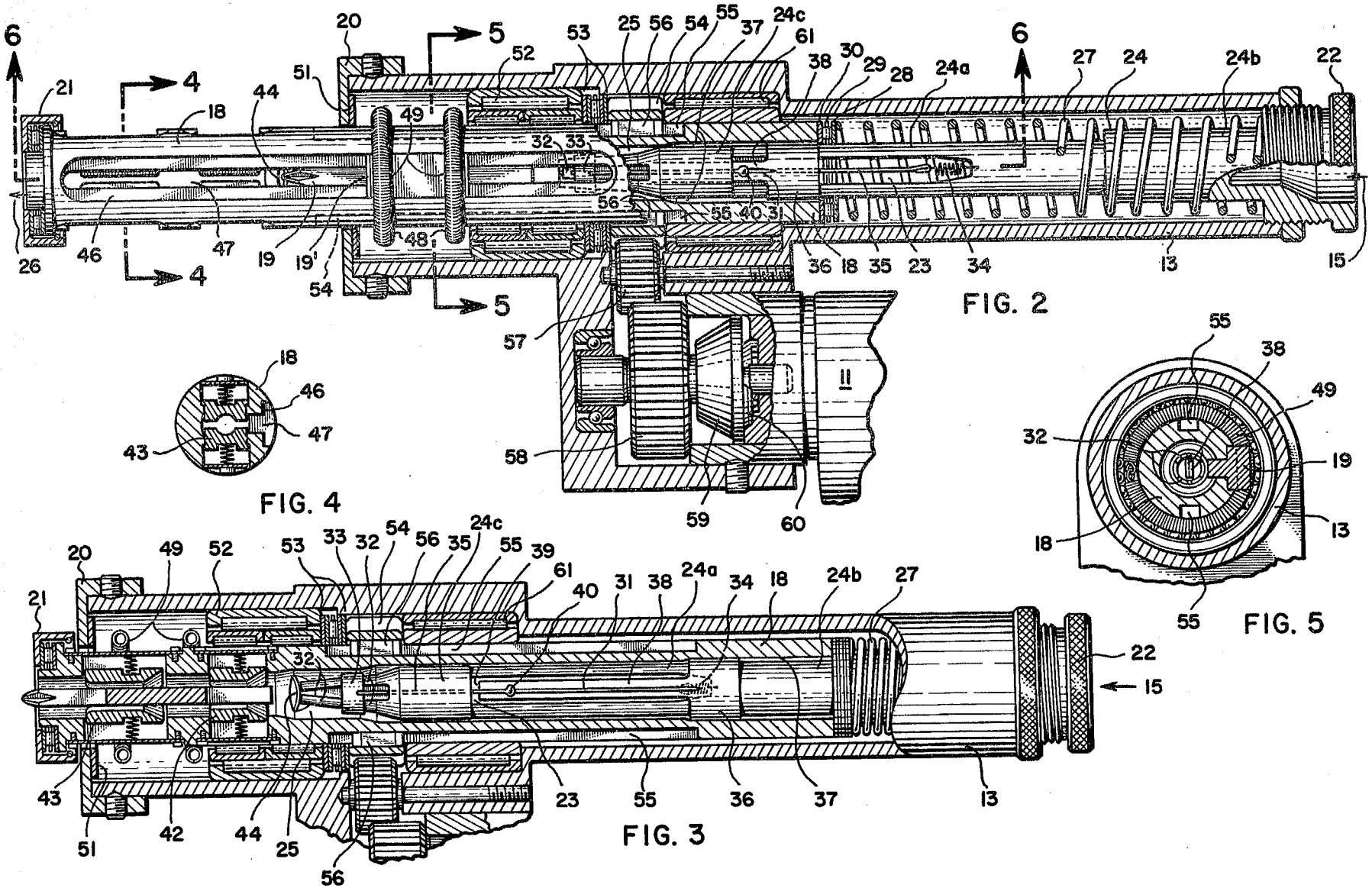
FIG. 2 shows a partial cutaway view taken along line 2—2 of FIG. 1, wherein the string of screws has been omitted to simplify location and identification of apparatus parts.
FIG. 3 is a partial cross section along the same line 2—2 as with FIG. 2, but showing the apparatus in a compressed state which occurs when the shaft is forced into the driver housing.
FIG. 4 is a cross section taken along the line 4—4 of FIG. 2.
FIG. 5 is a cross section taken along the line 5—5 of FIG. 2.

The driver housing and components contained therein are shown in greater detail in FIG. 2. It will be noted that screws enter the rearward receiving opening 15 and progress down the length of the channel defined by a stationary tube 24 which extends forward from the adjustment knob 22 into a hollow section 22 of the reciprocating shaft 18. The hollow of the reciprocating shaft forms a continuation of the channel extending through the stationary tube 24 and is contoured to conform to the forward part of the tube configuration. Each screw member proceeds down this hollow for engagement by the bit means 19 and advancement out the dispensing opening 26 at the impact cap 21.

Screw movement along the tube and shaft hollow is primarily actuated by the reciprocation of the shaft 18 into and out of the housing 13. Referring to FIG. 1, it should be noted that of the components shown, only the shaft 18 develops linear motion. The bit means, stationary tube, and housing are all immobile.

The tube 24, as illustrated in FIGS. 2 and 3, has an inner channel diameter larger than the largest diameter of a screw member and attached retaining means, to thereby facilitate their passage into the hollow of the reciprocating shaft 18. The outer diameter of the tube 24 is stepped with the forward section **24*a* having an outer diameter slightly less than the inner diameter of said reciprocating shaft, the rearward portion 24*b* of the tube having a larger diameter sufficient to block rearward movement of said reciprocating shaft beyond the forward face of the rearward tube section 24*b***.

The reciprocating shaft 18 is biased in a forward position (as shown in FIG. 2 in comparison to the compressed position of FIG. 3) by spring means 27. This spring means is stabilized around the tube 24 and enclosed within the driver housing 13. The back portion of the spring means is retained against the shoulder section of the adjustment nut 22. The front of the spring means contacts a washer 28, thrust bearing 29, washer 30 combination which abuts against a back face of the reciprocating shaft 18. The spring means is compressed when the face of the impact cap 21 is impressed against a wall and pressure is applied to the power source 11 or other rearward portions of the power screwdriver, driving the reciprocating shaft 18 into the driver housing as shown in FIG. 3. Rearward progress of the shaft 18 is terminated when the washer-thrust bearing combination approaches the stepped up tube diameter 24b at the rear of the driver housing.

The forwardmost section of the tube 24c tapers to a pair of radially converging, spring biased fingers 32. The unconstricted diameter of the forward opening formed by these fingers is slightly smaller than the diameter of the largest portion (head) of each screw member to pass therethrough. A tapered collar 33 encircles the spring biased fingers and is attached to a rearward spring 34 by means of a pair of connecting arms 35 which retract the collar 33 to a rearward location along the spring biased fingers as shown in FIG. 3. The diameter of the collar 33 is limited such that this rearward location (FIG. 3) maintains the spring biased fingers 32 at the smaller diameter to preclude radial displacement of the fingers as a trapped screw attempts to pass therethrough. This collar locking position for retaining a screw from forward movement within the shaft hollow is constant except when the shaft is in the extended state shown in FIG. 2.

This constricting collar 33 is released from its closed position (FIG. 3) by the action of a sleeve 36 which reciprocates along the exterior of the stationary tube 24 in response to the rearward movement of the shaft 18 and relative forward movement of the washer 30 which strikes a back-shoulder of the sleeve 36 causing the relative movement thereof. The sleeve 36 travels within a slightly enlarged hollow 37 of the rearward section of the reciprocating shaft 18. This releasing position permits a screw to be dislodged from the tube for carriage by the shaft to a forward point where it is engaged by the bit means. The releasing function of the sleeve 36 is discussed in detail hereinafter.

Extending from this sleeve 36 are a pair of radially converging fingers 38 connected at opposite sides of the sleeve and converging through slots 23 along the length of the tube section 24 to the central axis of the tube interior as is more clearly shown in the end view of FIG. 5. These fingers 38 are also spring biased so that a screw moving down the channel can force the pair of fingers apart and pass there-between. It is also these fingers 38 which provide the forward motion to eject the lead screw forward from within the first set of converging fingers 32. This occurs as the shaft moves in the forwardmost extended position shown in FIG. 2.

At the same time that the ejecting fingers 38 move into place behind a screw head, the sleeve 36 is forced forward by the washer-thrust bearing combination 30 whose opening diameter is less than the inner diameter of the sleeve as shown in FIG. 2. This permits deflection of the fingers 38 to a diameter greater than the screw head diameter. Consequently, the return of the shaft to its extended position (FIG. 2) causes the sleeve with the extending ejection fingers 38 to be pushed forward by the washer-bearing combination and to push a lead screw into the shaft hollow beyond the converging fingers 32.

As noted previously, the fingers 38 extending from the sleeve 36 also operate to reciprocate the collar 33 to alternately constrict and release the radially converging fingers 32. This action is timed with the ejection action of the previous paragraph to cause passage of a screw from the converging fingers 32, during the release phase as explained in the previous paragraph.

In addition, the constricting action of the collar 33 works in combination with the reciprocating shaft to sever the lead screw with attached retaining means 17 from the retaining means containing the following line of screws. The severing action is facilitated by a pair of small stops 40 which form an integral part of the connecting arms 35 attached at the collar 33. These connecting arms 35 pass through elongate slots 31 within each extending finger 38 to the biasing springs 34. As the sleeve 36 moves forward, the stops 40 catch in the rearward section of the finger slots 31, carrying the arm and collar forward by force of the washer-bearing combination. Since this action occurs only when the stops 40 contact the end of the finger slots 31, the release of the constricting collar is momentary. At that instant (FIG. 2) the ejecting fingers 38 push the screw head free of the collar and converging fingers 32.

When the shaft 18 is returned into the housing 13, a shaft mounted spring biased dog 44 passes the head of the screw released from the converging fingers 32. During this rearward motion of the shaft, the sleeve 36 returns rearward and releases the stops 40. The biasing springs 34 pull the collar 33 into a constricting position, forcing the fingers 32 to constrain the following screw. This action permits the shearing of the retaining means 17 when the shaft later moves forward in response to release of spring means 27. FIGS. 6–10 illustrate the movement sequence of the string of screws through the shaft, along with the shearing action which occurs between the sequence represented by FIGS. 7 and 8.

Figures 6, 7, 8, 9:
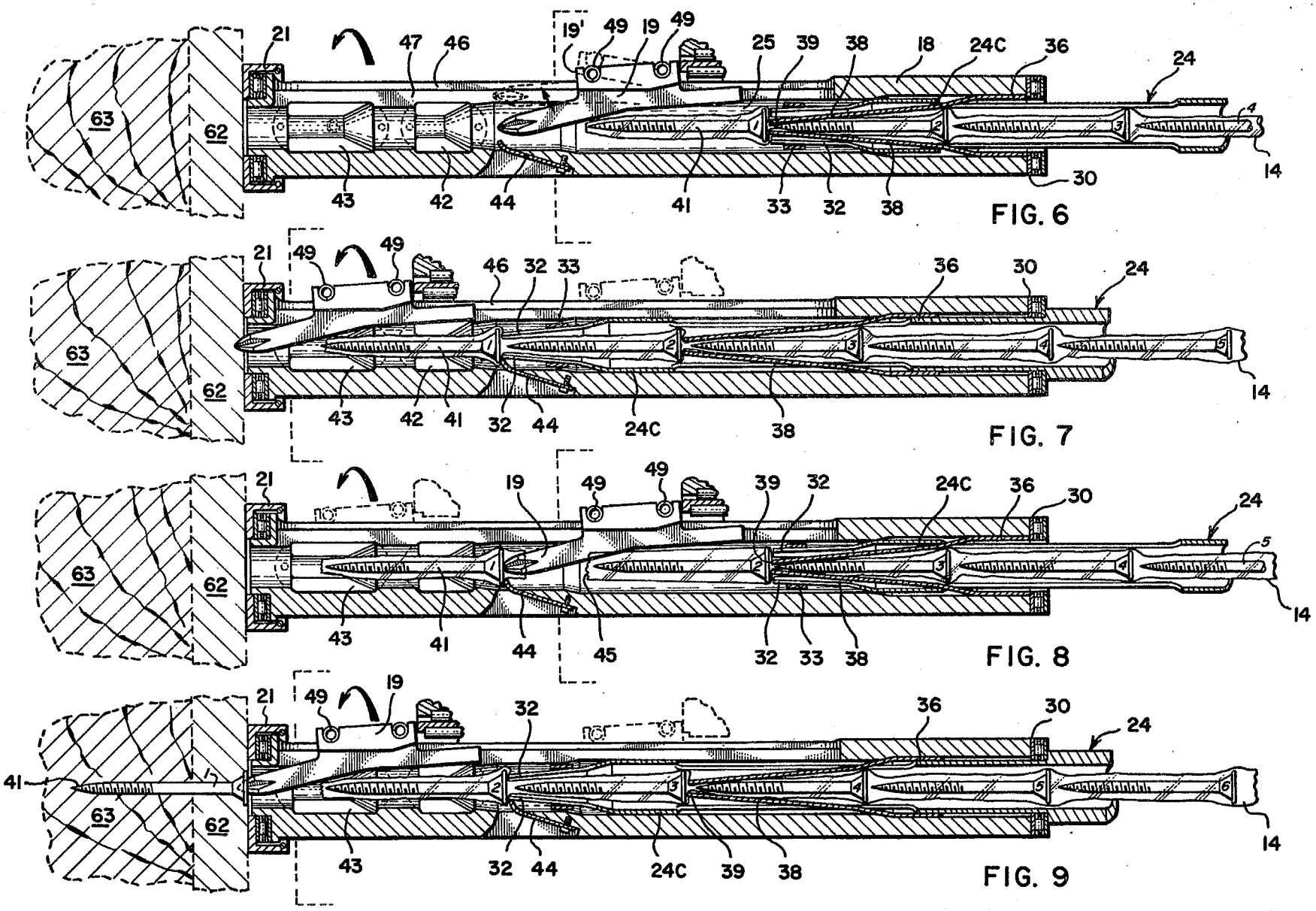
FIG. 6 is a cross section taken along the line 6—6 showing the movement of the string of screws through the shaft and associated apparatus for emplacement in a wall or receiving medium shown at the left of the figure.
FIG. 7 illustrates a similar cross section as FIG. 6 showing the shaft and apparatus in the compressed stage as illustrated in FIG. 3.
FIG. 8 represents a similar view as shown in FIGS. 6 and 7, with the shaft and apparatus in the extended form with the bit engaging the locked, lead screw.
FIG. 9 illustrates the operation of the bit emplacing a screw in the wall with a new lead screw being locked in position for engagement by the bit upon extension of the shaft.

Referring to FIGS. 2 and 6 through 10, the string of screws 14 is inserted in the driver housing 13 through the rearward opening 15, down the channel within tube 24, with the lead screw 41 being pushed past the two sets of radially converging fingers 38 and 32. The position of the front cap 20 of the housing 13 and bit are shown in phantom line to illustrate the relative shaft location with respect thereto. As the lead screw 41 passes the inner converging fingers 38, the finger ends 39 spring together at the face of the screw head (FIG. 6). These finger ends 39 operate to eject the lead screw 41 past the converging fingers and into the shaft hollow as shown in FIG. 6. As the shaft is thrust into the housing 13, the lead screw is repositioned to the forward section of the shaft hollow as shown in FIG. 7.

The dog 44 is located rearward of the lead screw, which is stabilized between a first and second pair of alignment jaws 42 and 43. As the shaft moves forward, the head of the lead screw 41 catches on the spring biased dog 44 and is carried past the bit means 19, which deflects into the tracking slot 47 (FIG. 4) as shown in phantom lines on FIG. 6. In addition to assisting in screw alignment, the first set of jaws 42 holds the screw in position for seating of the bit tip at the screw head. FIG. 8 illustrates the seating position within the shaft.

Figure 10:
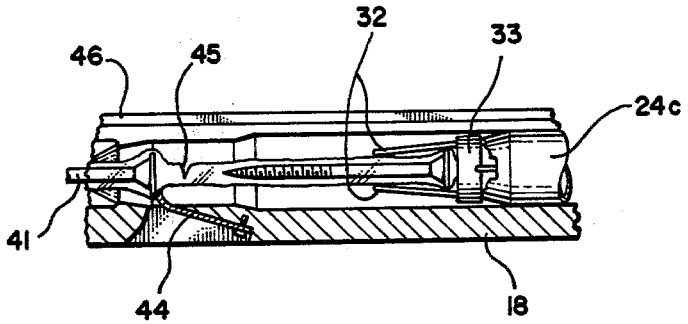
FIG. 10 is a fragmentary, cross section view of the shaft at a time interval between the FIG. 7–FIG. 8 sequence, at a shearing location.

During the forward motion of the shaft between the representations of FIGS. 7 and 8, the screws following the lead screw are drawn forward and the collar 33 is pulled into its rearward location by the connecting arm 35 and spring 34 coupled to the tube wall 24. As explained earlier, this action occurs when the stops 40 are released from the finger slots 31. The radially converging fingers 32 are thereby constricted and catch the following screw as shown in FIG. 10. Because the lead screw 41 is caught by dog 44 and must move forward with the shaft, and in view of the constricted path of the fingers 32 which preclude release of the following screw, the separating forces occurring during the forward movement of the shaft sever the retaining means or plastic which forms the flexible portion of the string of screws. This shearing stage occurs in the time sequence between FIG. 7 in the fully compressed state and FIG. 8 in the fully extended state. With the severing 45 of the retaining means 17, the bit means 19 is permitted to slide into the axis of the shaft to be ready for engagement upon rearward motion of the shaft during the compression cycle.

FIG. 8 illustrates a second repetition of the reciprocating motion, with the bit means tip engaging the screw head for emplacement in the wall or similar receiving medium. As previously indicated, the shaft and mounted bit means are constantly rotating during use. Therefore, as the bit means engages the screw the slotted head is received at the bit tip and commences to rotate in concert with the bit means and shaft.

During the forward and rearward movement of the shaft as shown in FIGS. 6, 7, 8 and 9, the bit means travels within an elongate notch 46 (FIG. 2) which is slotted at a central portion thereof 47, the combination elongated notch and slot extending along the length of the shaft 18. The slot portion 47 is of sufficient width to permit the bit tip portion of the bit means 19 to displace out of the shaft hollow and into the slot area. This is necessary to permit a screw to pass thereby for subsequent engagement by the bit tip.

The notch forms a track means for carrying a shouldered portion or tracking member of the bit means 19. The bit means is maintained within the notch by means of circumscribing spiral springs 48 which are journaled in recess notches 49 in the tracking member portion of the bit means. Because of this spring-type mounting of the bit means, the displacement of the bit tip out of the hollow of the shaft as shown in phantom lines in FIG. 6 is facilitated. As indicated earlier, this displacement occurs in response to forces applied by the advancing lead screw as it is carried forward past the bit means by the dog 44. The spiral springs operate to restore the bit tip to its central location within the shaft hollow for engagement with the forwardly located screw head. The stationary linear position of bit means 19 is maintained by a forward limiting point against a thrust bearing 51 which is mounted at the interior face of the retaining cap 20. Forward movement of the bit means past the retaining cap and thrust bearing combination 20 and 51 is blocked because of the extension of the bit means tracking member beyond the diameter of the shaft as shown more clearly in FIGS. 6 through 9. It is this forward tracking member face 19' which impacts at the thrust bearing 51, thereby limiting forward movement of the bit means when the reciprocating shaft is advancing forward.

Backward movement of the bit means 19 in response to the rearward movement of the reciprocating shaft is precluded by contact of the rearward face of the tracking member portion of the bit means at a double roller bearing 52 which also serves to stabilize the constantly rotating shaft at a proper axis of rotation. This roller bearing 52 permits continuous rotation of the circumscribed shaft therein, as well as reciprocal movement therethrough. The back face of the roller bearing abuts against a washer pair, thrust bearing, washer pair combination 53 which reduces rotational friction within the mechanism.

The reciprocating shaft is rotated by a circumscribing external tooth, ring gear 54 which is keyed to the shaft 18 by a pair of keys 56 which travel along a pair of keyways 55 extending into the exterior of the shaft 18 and into the interior surface of the ring gear 54. This ring gear is thereby coupled to the rotational motion from the power train consisting of a first spur gear 57 and a second spur gear 58 which is coupled to a splined driver 59. The splined driver is configured to mate with a second splined driver 60 coupled to a power source 11.

To maintain the key coupling with the power train in proper radial alignment, a second double roller bearing 61 circumscribes the shaft and is contacted at the rearward side of the ring gear 54 which rotates the shaft 18. The back side of the second double roller bearing 61 abuts against the back inside face of the screwdriver mount 12.

It will therefore be noticed that the components contained within the screwdriver mount 12 do not experience any substantial linear motion, but rotate in concert with the reciprocating shaft which is keyed thereto. These components include the bit means 19, the double roller bearing 52, the washer thrust bearing combination 53, the ring gear 54 with key coupling to the power train, and the second double roller bearing 61.

As an example of one of the possible uses for the subject invention, the following discussion relates to emplacement of drywall screws. A first, lead screw is pushed through the rearward opening 15 down the channel and through the respective converging finger pairs 38 and 32, past the bit means (displacing the bit tip into the slot 47 of the shaft) and into the alignment jaws 42 and 43. With this first screw in the forward position as indicated in FIG. 8, the automatic loading procedures can be utilized without further need to manually load each individual screw. The initial loading of the first screw may be accomplished by any plunger or rigid shaft which can push the first screw into its forward mounting location. A string of screws 14 is then inserted into the driver housing through the rearward opening 15 and into the orientation shown in FIG. 8. The power screwdriver is now ready to operate without interruption.

The power source 11 is actuated which causes the constant rotation of the shaft and coupled bit means. To mount a drywall screw, the user places the face of the impact cap 21 against a sheet of drywall 62 to be mounted to a supporting stud 63. As the user pushes forward on the automatic screwdriver and power source 11, the shaft is pushed into the driver housing, causing the relative forward motion of the screws contained within the tube 24. At the same time, the front screw is engaged by the tip of the bit means which causes it to rotate therewith, having its alignment maintained by the two pairs of alignment jaws 42 and 43. As the user continues to push on the apparatus, the screw moves forward and makes contact with the drywall and is driven into the drywall by the action of the rotating bit and pressure applied by the user.

At the same time that the rotating bit moves forward, the tube 24 with its radially converging finger pairs 32 and 38 operate as a feed means to place the next screw in proper position for pickup by a spring biased dog 44 within the hollow of the shaft. When the screw is in the fully emplaced position as shown in FIG. 9, the following screw is in the lead position, locked in place by the dog 44 to preclude its rear movement with the following screws when the shaft returns forward upon release of pressure by the user to the apparatus.

When pressure is removed from the apparatus, the shaft commences its forward return to a static configuration with the shaft fully extended as in FIGS. 6 and 8. During this return motion, the collar, as shown in FIG. 8, permits the following screw to slip within the converging fingers in response to the motion of the lead screw retained by dog 44. The following screw, however, (screw 3 in FIG. 9) will only be pulled forward until its head engages the constricted fingers 32. As the shaft continues to move forward, the retaining means or plastic is torn apart 45 and the constricted screw is retained rearward while the forward screw is carried past the bit means by the dog. As the shaft reaches its forwardmost position, the bit means drops behind the face of the lead screw head and is in the ready position for engaging and emplacing the screw upon the next forward thrust (FIG. 8).

As the shaft approaches this position of full extension (FIG. 8), the sleeve 36 contacts the face of the front washer 30 and is pushed forward with the forward moving shaft. The attached fingers 38 are carried forward, catching the stops 40 on the connecting arms 35 (FIG. 2). The continued forward movement of the sleeve 36 thereby causes both the collar 33 and finger ends 39 to move forward along the tube, releasing the constricting fingers 32 and ejecting the screw that was formerly trapped therein. This ejected position is reached upon full extension of the shaft as shown in FIG. 8.

Upon rearward displacement of the shaft into the driver housing and concurrent emplacement of the lead screw in the drywall, the ends of the converging finger pairs 32 and 38 carry the next lead screw into the locked position at the dog 44. This screw is now in place for engagement by the bit means when the cycle of operation is repeated, with FIGS. 8 and 9 illustrating the alternating forward and rearward locations for the reciprocating shaft and feed means.

Although preferred forms of the invention have been herein described, it is to be understood that the present disclosure is by way of example only and that variations are possible without departing from the scope of the hereinafter claimed subject matter, which subject matter is to be regarded as the invention.

I claim:

1. Automatic screw driver apparatus including:

(a) a flexible string of screws comprising a plurality of screws attached in head to tip orientation to a length of flexible retaining means which provides flexibility between a preceding screw head and a following screw tip, said retaining means being severable in response to a separating force applied prior to emplacement of said screw into a receiving medium;

(b) a driver housing having an elongate channel along its length with receiving and dispensing openings within said channel for guiding said string of screws into a position for emplacement;

(c) feed means located within said housing for advancing said string of screws therethrough;

(d) means within said housing for severing said retaining means between a lead screw and remaining screws of said string of screws;

(e) rotating bit means within said housing for engaging and rotating said severed lead screw along its threaded axis while moving said screw forward along said channel toward said receiving medium;

(f) alignment means located near said dispensing opening of said channel and within said housing for positioning and maintaining said engaged screw on a common axis of rotation with said rotating bit means during emplacement of said screw in the receiving medium; and (g) means for returning said bit means to a rearward engaging position for engagement of a subsequent severed screw from said advancing string of screws.

2. Apparatus as defined in claim 1, wherein said retaining means connecting said string of screws comprises a thin flexible casing at least partially enclosing said screws in head to tip relation.

3. Apparatus as defined in claim 2, wherein said casing is fabricated of material selected from the group consisting of paper, plastic, fabric and flexible adhesives.

4. Apparatus as defined in claim 1, further comprising a power transmission coupled between said bit means and a power source and operable to constantly rotate said bit means during operation of said power source.

5. Apparatus as defined in claim 1, wherein said bit means is coupled to and extends within a hollowed shaft which is partially retained within said housing, said shaft and bit means being rotated in concert to turn said engaged screw, said shaft hollow comprising a forward part of said elongate channel.

6. Apparatus as defined in claim 5, wherein said hollowed shaft further comprises slot means extending along a portion of the length thereof for receiving a tracking member section of the bit means therein to enable relative reciprocating tracking motion of said bit means with respect to said shaft in combination with the rotation thereof.

7. Apparatus as defined in claim 5, wherein said feed means includes a tube having an opening therethrough as part of said channel and a forward tube section with an outer diameter slightly smaller than the rearward opening of said shaft hollow and an inner diameter larger than the diameter of the screw head passing therethrough, said tube being coupled within said housing with means for developing relative reciprocating movement of said forward tube section into said shaft hollow, the tube further comprising means for sequentially urging said screws along said channel into the shaft hollow.

8. Apparatus as defined in claim 7, further comprising deflectable dog means projecting radially within the hollow of said shaft for catching the lead screw, carrying it forward of said bit means during relative forward movement of said shaft.

9. Apparatus as defined in claim 8 further comprising means for holding following screws in fixed position during the relative forward movement of said shaft with the accompanying lead screw to thereby stretch said retaining means and sever the same.

10. An automatic feeding, power screwdriver for use with a string of screws fixed in head to tip orientation by flexible retaining means, said screwdriver including:

(a) a screw bit means having a bit tip configured to engage a portion of a screw head and a bit body for supporting said bit tip, said body including a tracking member;

(b) a rotatable hollow shaft having track means extending along a portion of the length of the shaft wall for receiving said bit tracking member therein in manner such that said bit tip is normally positioned at the axis of said shaft during engagement of said screw head, said bit means being slidably displaceable along said track means in response to relative reciprocating movement of said shaft;

(c) bit mounting means for substantially retaining said bit tracking member in said shaft track means while permitting radial displacement of said bit tip away from said axis to allow passage of a screw thereby prior to engagement of said screw by said bit tip;

(d) dog means fixed to said reciprocating shaft and operable within the hollow thereof for catching and moving a screw forward of said bit tip;

(e) guide means connected to said shaft for coaxially aligning said engaged screw within said shaft hollow;

(f) feed means coupled to said shaft hollow for delivering said string of screws into said shaft, said delivery being in tip to head orientation for each sequential screw;

(g) means within said shaft for separating the first screw of said string of screws from the following retained screws in preparation for engagement thereof by said bit tip;

(h) means for constantly rotating said shaft and attached bit means during operation of the screwdriver; and (i) means adapting said shaft for reciprocating movement to thereby cause the catch means to sequentially advance the lead screw past the bit means for engagement thereby upon return movement of the shaft for emplacement in a receiving medium.

11. A screwdriver as defined in claim 10, wherein said bit body is at least partially positioned off center of said shaft axis and said tracking member portion of said body rests in said track means, said track means including a slot of width greater than the diameter of said bit tip to permit radial displacement of said tip away from said axis into said slot to permit passage of a screw thereby.

12. A screwdriver as defined in claim 11, wherein said track means comprises a recessed channel extending laterally of said slot to provide a shoulder to carry said tracking member.

13. A screwdriver as defined in claim 10, wherein said bit mounting means comprises a spiral spring circumscribing said shaft and journaled in said tracking member to retain the bit means therein during reciprocating movement.

14. A screwdriver as defined in claim 10, wherein said guide means for coaxially aligning said engaged screw comprises a pair of deflectable jaws partially defining a common channel for screw passage, having a channel diameter approximately equal to the diameter of the threaded shank of the screw, said jaws being spring biased to permit deflection thereof in response to the passage of the screw head therethrough, said channel having a channel axis substantially coincident with the axis of said shaft.

15. A screwdriver as defined in claim 10, wherein said dog means comprises a spring biased leaf attached to said shaft and having a lip protruding into said hollow, said lip being partially displaceable from said hollow in response to a passing screw head.

16. A screwdriver as defined in claim 10, wherein said feed means comprises a tube having a receiving end and a dispending end, said dispening end having radially converging, spring biased constricting fingers defining a restrictive channel adjustable to a diameter slightly smaller than the diameter of the screw head, thereby resulting in tension at the retaining means as the screws are drawn through the restricted channel, said tension being sufficient to separate the retaining means forward of said dispensing end.

17. A screwdriver as defined in claim 16, wherein said feed means includes a slot opening through the walls thereof extending toward said dispensing end and a slidable sleeve circumscribing said feed means with an attached spring biased finger extending from the exterior of said walls through said tube slot into the tube interior for urging screw advancement therein beyond said constricting fingers in response to reciprocating means which drives said sleeve and connected finger in alternating forward and backward movement, the end of said finger deflecting aside in response to each passing screw during said backward movement.

18. A screwdriver as defined in claim 17, further comprising a constricting collar circumscribing said constricting fingers, said fingers being spring biased to radially distend as said collar is urged forward along the direction of convergence in response to contact with reciprocating means, said collar having means for returning it to an initial rearward position to thereby alternately constrict and release said fingers around sequential screws passing therethrough.

19. A screwdriver as defined in claim 18, wherein said constricting-collar-forward-movement and said sleeve-connected-finger-advancement are coupled to the sleeve which actuates both movements in concert to release the constricting collar and concurrently eject a screw therefrom.

20. A screwdriver as defined in claim 19, wherein said collar is coupled through a slot along the length of said urging finger to said tube by a movable, rigid connecting arm which has a stop intermediate the length of said arm for engaging said slot along the length of said urging finger to urge said connecting arm forward to release said collar in conjunction with the forward motion of said sleeve and extending finger within said feed means.

21. A screwdriver as defined in claim 20, wherein said collar is pulled to a constricting position by spring means coupling said connecting arm to said tube, said constricted position being maintained by said collar during forward movement of said shaft, said forward movement being operable to separate said first screw from the following retaining means of said following screws.

22. A screwdriver as defined in claim 10, wherein said shaft includes a first key way extending along the length of a portion of the exterior of said shaft for receiving key means jointly received in a second key way at the interior surface of a circumscribing ring gear having means for coupling said gear to a power source for turning the gear/shaft combination and further comprising means for permitting relative reciprocal movement of said key means and ring gear along said first key way in concert.

23. A screwdriver as defined in claim 10, further comprising a rotatable impact cap mounted at the forward end of said reciprocating shaft, with a thrust bearing positioned between the inside face of said cap and the forward end of said shaft.

24. A screwdriver as defined in claim 10, further comprising an adjustment means coupled to said feed means to provide linear adjustment of said feed means with respect to said shaft.

25. A screwdriver in claim 10, wherein said feed means comprises a tube having a rearward receiving end and a forward dispensing end, said dispensing end having radially coverging, spring biased constricting fingers partially defining a restrictive channel and having constricting means adjustably coupled to said constricting fingers to sequentially constrict and release said fingers to and from a channel diameter slightly smaller than the diameter of the screw head, thereby adapting said fingers to supply tension at the retaining means as the screws are attempted to be drawn through the restricted channel, said tension being sufficient to separate the retaining means forward of said dispensing end when said fingers are constricted to the smaller diameter.

26. A screwdriver as defined in claim 25, wherein said feed means tube includes a slidable sleeve circumscribing said feed means tube with an attached spring biased finger extending into the tube interior for urging screw advancement therein beyond said constricting fingers in response to reciprocating means which are adapted to drive said sleeve and connected finger in alternating relative forward and backward movement, the end of said finger deflecting aside in response to each forward passing screw during said backward movement and being operable to push a screw forward with the tube during the forward movement.

27. A screwdriver as defined in claim 26, wherein said constricting means comprises a constricting collar circumscribing said constricting fingers, said fingers being spring biased to radially distend in response to a screw being pulled therebetween when said collar is in a forward, nonconstricting position, said collar having means for returning it to an initial rearward position to thereby constrict said fingers to the smaller diameter around sequential screws passing therethrough.

28. A screwdriver as defined in claim 27, wherein said constricting-collar-forward-movement and said sleeve-connected-finger-advancement are coupled to the slidable sleeve to adapt both the collar and finger movements to occur in concert to release the constricting collar and concurrently eject a screw forward therefrom.

* * * * *